US006199280B1

(12) United States Patent
Schneider et al.

(10) Patent No.: US 6,199,280 B1
(45) Date of Patent: Mar. 13, 2001

(54) METHOD AND DEVICE FOR ASSEMBLING FLEXIBLE PLATES, FOR EXAMPLE PRINTING PLATES

(75) Inventors: Georg Schneider, Würzburg; Karl Robert Schäfer, Rimper, both of (DE)

(73) Assignee: Koening & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/423,301

(22) PCT Filed: May 9, 1998

(86) PCT No.: PCT/DE98/01294

§ 371 Date: Nov. 9, 1999

§ 102(e) Date: Nov. 9, 1999

(87) PCT Pub. No.: WO98/51499

PCT Pub. Date: Nov. 19, 1998

(30) Foreign Application Priority Data

May 9, 1997 (DE) ..... 197 19 559

(51) Int. Cl.[7] ..... B41C 1/18

(52) U.S. Cl. ..... 29/895.211; 29/895.21; 101/415.1; 101/486

(58) Field of Search ..... 29/235, 243.5, 29/451, 509, 895.21, 895.211, 895.23; 101/415.1, 477, 486, 382.1, 385, 386

(56) References Cited

U.S. PATENT DOCUMENTS

| | | | | |
|---|---|---|---|---|
| 4,727,807 | * | 3/1988 | Suzuki et al. | 101/415.1 |
| 5,094,165 | * | 3/1992 | Sugiyama et al. | 101/415.1 |
| 5,526,747 | * | 6/1996 | Marmin et al. | 101/477 |
| 5,560,298 | | 10/1996 | Krokolinski et al. . | |
| 5,678,487 | * | 10/1997 | Guaraldi et al. | 101/415.1 |

FOREIGN PATENT DOCUMENTS

| | | |
|---|---|---|
| 1960635 | 8/1972 | (DE) . |
| 44 47 088 C1 | 2/1996 | (DE) . |
| 0710556 A1 | 10/1995 | (EP) . |
| 62-169646 | 7/1987 | (JP) . |
| 05212855 | 8/1993 | (JP) . |

* cited by examiner

*Primary Examiner*—I. Cuda Rosenbaum
*Assistant Examiner*—Eric Compton
(74) *Attorney, Agent, or Firm*—Jones, Tullar & Cooper, PC

(57) ABSTRACT

Flexible plates are placed on a plate cylinder by inserting leading and trailing plate suspension legs into cooperating slits. Each of the plate suspension legs is pushed into the receiving slit by an insertion device that uses plate front and rear insertion sliders. These two insertion sliders each act as a guide for the adjacent slider.

12 Claims, 4 Drawing Sheets

METHOD AND DEVICE FOR ASSEMBLING FLEXIBLE PLATES, FOR EXAMPLE PRINTING PLATES

FIELD OF THE INVENTION

The present invention relates to a device for mounting flexible plates such as flexible printing plates, as well as to an associated method. An insertion slider is used to place the beveled or angled plate ends into cooperating slits formed on the surface of the flexible plate receiving cylinder.

DESCRIPTION OF THE PRIOR ART

A device for inserting the trailing end of a flexible printing plate into a clamping device on a plate cylinder is known from JP 62-169646 A.

A cylinder with fastening slits for printing plates or support plates, whose ends are beveled at acute, or obtuse angles is known from DE 19 60 635 C, The fastening slit extends along a secant through the cylindrical cross section of the cylinder, i.e. it extends obliquely in relation to the diameter of the cylinder.

EP 0 710 556 A1 shows a device for mounting a flexible plate, which has a leading suspension leg beveled at an acute angle, and a trailing suspension leg beveled at an obtuse angle, in a fastening slit of a cylinder. An insertion slider is provided for inserting the trailing suspension leg.

SUMMARY OF THE INVENTION

The present invention is based on the object of creating a method, as well as an associated device, for mounting flexible plates, which are provided with suspension bevels, on a cylinder of a rotary printing press, which cylinder is provided with a fastening slit.

This object is attained by means of the provision of an insertion slider that cooperates with the trailing suspension leg of the flexible plate. Another insertion slider, which cooperates with the leading suspension leg is also provided. Both of these insertion sliders are shaped to cooperatively engage the angled flexible plate ends and to move the plate ends into the corresponding angled plate end receiving slits on the plate receiving cylinder.

The advantages which can be achieved by means of the present invention reside, in particular, in that a dependable insertion of a suspension bevel at the end of a printing plate is also assured in case of fastening slits of a cylinder of a rotary printing press which are manually difficult to access. The device of the present invention consists of few mechanical components and is used for suspending a front suspension leg, as well as a rear suspension leg, of a printing plate in the fastening slits of a cylinder. It is also possible to arrange several printing plates at the circumference, and several printing plates over the axial length of the cylinder.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
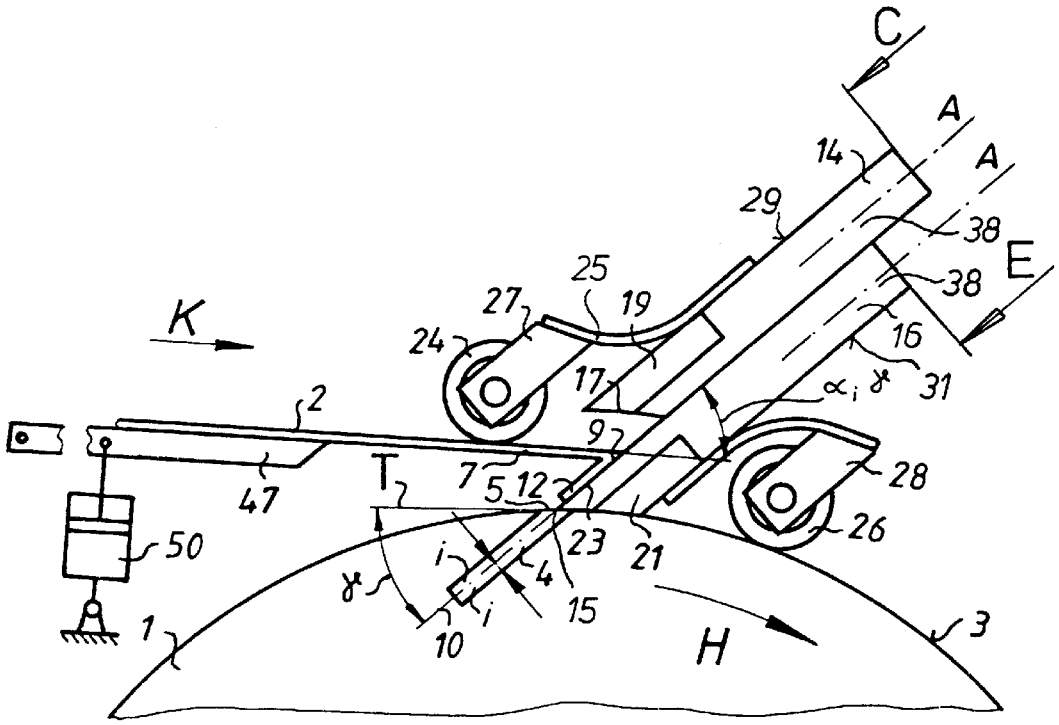
FIGS. 1 to 5, various work positions of the device in accordance with the present invention in schematic representation in the course of mounting a printing plate and with actuation elements removed for clarity of illustration, FIG. 6, a plan view, taken in the direction indicated by the arrow K in FIG. 1 and showing the right side of the device in FIG. 1, and with actuating elements, and in FIG. 7, a work position analogous to FIGS. 1 to 5 in accordance with a variation of the method.

For receiving, for example flexible printing plates 2, a cylinder 1, for example a plate or a rubber blanket cylinder of a rotary printing press, is provided with axially extending, plate end fastening slits 4 and 6, as seen in FIGS. 1–5, with these slits extending from a surface 3 of the cylinder 1 into the interior of the cylinder 1. In this way, it is possible to fasten a flexible plate 2, for example a printing plate, or support plate with a rubber blanket vulcanized on it, on the circumference of the cylinder 1. The plates 2 have a thickness of 0.3 mm, for example.

On the plate beginning or leading end 7 and at its trailing end 8, the plate 2 is provided with at least one front or leading and one rear or trailing plate suspension bevel 9, 11, also called a leading suspension bevel 9 or a trailing suspension bevel." Each suspension bevel 9, 11 has a front, or a rear, suspension leg 12, 13, respectively.

The opening angle $\alpha$ of the "leading" bevel 9 is acute, for example up to 45°. The opening angle $\beta$ of the "trailing" bevel 11 is obtuse. The sum of both angles is 180°, or respectively approximately 180°. However, the trailing end of the plate 2 need not be beveled. In that case, it is held in some other way on the surface 3.

In the depicted embodiment, each of the fastening slits 4, 6 is designed as a slit extending in an axis-parallel direction, over the length of the cylinder 1 and extending into the interior of the cylinder 1 and characterized by a center line. A width of each slit 4, 6 is at least some tenths of a millimeter greater than twice the thickness of the plate 2, or respectively the support plate for the rubber blanket, or the support plate plus the rubber blanket to be received mi the slit. Therefore both suspension legs 12, 13 can be received together in one slit.

The leading end fastening slit 4 is inclined at an acute angle $\gamma$ of for example 35° in the direction toward the surface of the cylinder 1 opposite to the direction of rotation H of the latter as seen in FIG. 1. The angle $\gamma$ results as an included angle between a plane 10, A which is stretched from the fastening slit 4, 6 through the intersection point 15, and a tangent line T, wherein the intersection point 15 of the plane 10 with the cylinder surface 3 is at the same time the point which is located on half the length of the virtual arc over the insertion opening of the fastening slit 8, 9 on the circle of the cylinder 1 and is touched by the tangent line T.

The opening angles $\alpha$ and $\beta$ of the suspension bevels 9, 11 of the plate 2 are matched to the angles of inclination $\gamma$ of the fastening slits 4, 6.

A device for mounting, and for removing the flexible plate 2, for example a printing plate, is arranged on the cylinder 1. This device essentially consists of two front insertion sliders 14 and two rear insertion sliders 16, which can be placed against the surface 3 of the cylinder 1.

The front and rear insertion sliders 14, 16 can be moved toward and away from the surface 3 of the cylinder 1 along the inclined plane 10, A as seen in FIG. 1. In the insertion position of the plate, the plane 10 and the plane A coincide. The insertion sliders 14, 16 are arranged back to back with guide surface 22 on guide surface 23 so they slide on each other. They extend over the entire axial length of each of the fastening slits 4, 6.

An underside 17, 18 of each insertion slider 14, 16 respectively facing the surface 3 of the cylinder 1 has suction openings 19, 21, for example eight such suction openings for drawing up an end 7, 8 of the plate 2. The underside 17, 18 of each insertion slider 14, 16 is concavely arched at a radius, which is matched to the radius "r" of the cylinder 1. Suction devices made of rubber are installed in the suction openings 19, 21, each of which projects only slightly past the underside 17, 18.

Each of the insertion sliders 14, 16 has a back guide surface 23 facing the back guide surface 22 of the other opposing insertion slider 14, 16 for the purpose of guiding the beveled edges 7, 8 of the plate 2 during their insertion into the fastening slit 4.

In accordance with another preferred embodiment, the guide surfaces 22, 23 can also be on another slider, not represented, which is located between the insertion sliders 14, 16 and which can be separately actuated.

Furthermore, each insertion slider 14, 16 cooperates synchronously with a number of pressing rollers 24, 26, for example two such pressing rollers 24, 26, for each plate end. On the exterior 29, 31 of the insertion slider 14, 16 which is remote from the guide surface, each pressing roller 24, 26 is preferably resiliently connected by means of a holding device 27, 28, for example leaf springs 25, with the insertion sliders 14, 16. By means of this suspension, the pressing rollers 24, 26 reach the surface 3 of the cylinder 1 at the same time as the underside 17, 18 of the insertion slider 14, 16. In a variation, the pressing roller 24, 26 touches the surface 3 even before the underside 17, 18. It is possible, by means of this, to prestress the free end of the plate 2, which freely projects past a guide 54 and one end of which is supported on its end, and the other end on that of the guide surfaces 23, 22. It is attained by this that it is easier to thread the suspension leg 12. The holding device can advantageously be designed as a leaf spring, or can be connected with a leaf spring 25.

Figure 6:
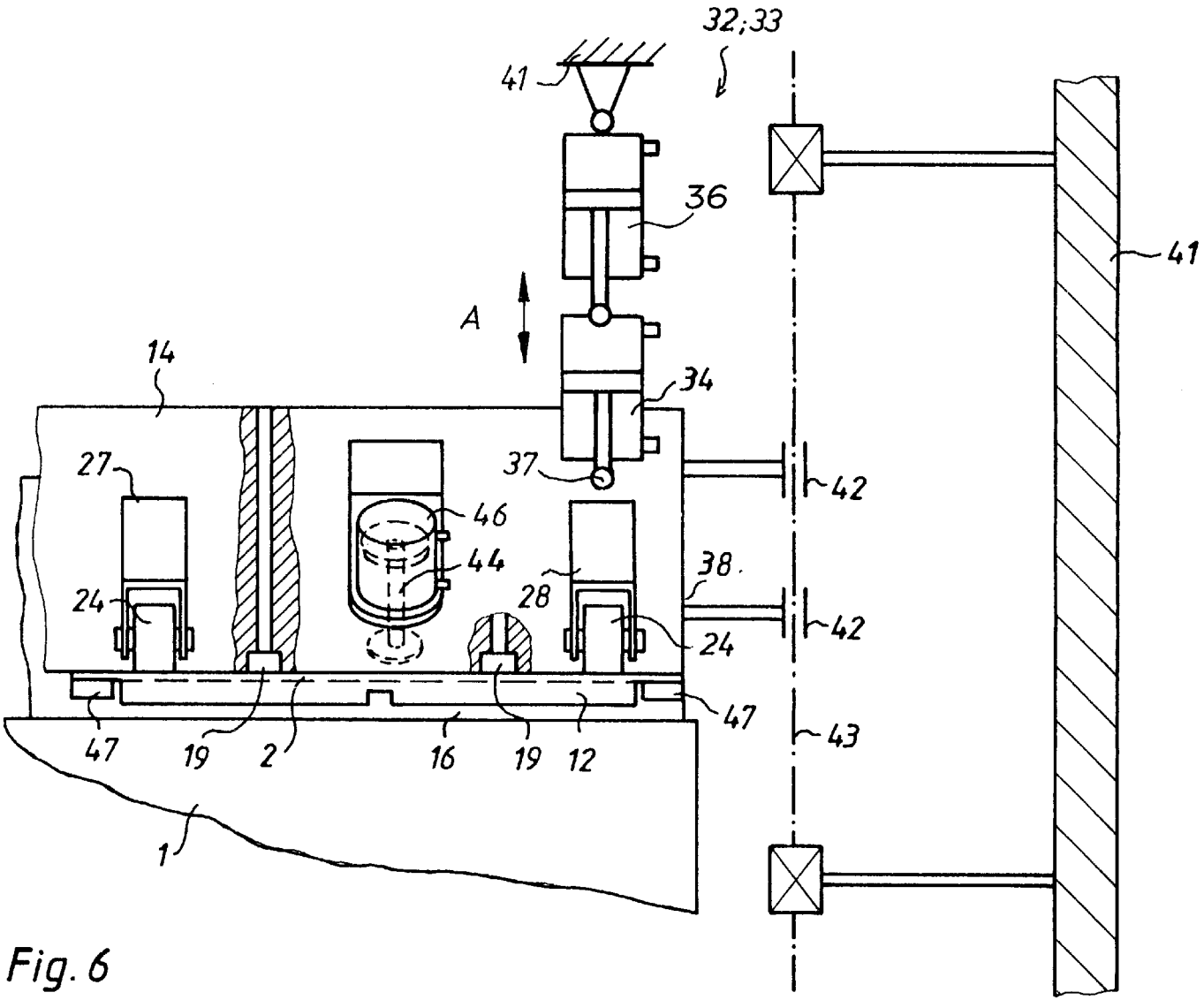

Each insertion slider 14, 16 is provided with a linear drive 32, 33 on each end, as seen in FIG. 6 for moving each insertion slider 14, 16 forward and back along the plane A. The linear drive 32, 33 consists, for example, of two respectively series-connected double-acting work cylinders 34, 36. The end of the piston rod of the work cylinder 36 is interlockingly connected with the end plate of the second work cylinder 34. The end 37 of the piston rod of the second work cylinder 34 is connected with the front 29 of the insertion slider 14, or respectively with the front 31 of the insertion slider 16.

Each insertion slider 14 and 16 has sliding bushings 42 on it left and light front side 38, as seen in FIG. 6. They are used as a guide on a guide spindle 43, which is fixed in place on a lateral frame.

The respectively two linear drives arranged on the exterior 29, or respectively 31, of the insertion sliders 14, 16 operate synchronously per insertion slider 14, or respectively 16.

The insertion sliders 14, 16 each can take up different positions C, D, E, P: as seen in FIGS. 1–5 and 7. These include 1. a topmost position C remote from the surface, and 2. a central position D This central position D allows the contact-free rotation of the cylinder 1 with the plate 2 suspended on it. It is limited by the stroke f of the work cylinder 34. The insertion slider 14, 16 is moved by the additional extension of the piston rod of the work cylinder 36.

3. a lowermost position E near the cylinder

The undersides 17, or respectively 18, of the insertion slider 14, 16 touch the cylinder surface 3. If a plate 2 already rests on the surface 3, the stroke g of the cylinder 36 is limited.

4. into a position P.

This position P lies below the position D and above the position E. The position P is sufficiently distanced from the surface 3, so that a clamped-in plate 2, or respectively support plate with a lubber blanket, is not touched.

The length of a suspension leg 12, 13 of a plate 2 maximally corresponds to the stroke length "f" of the cylinder 34.

In accordance with another preferred embodiment, the linear drive 32, 33 can also consist of a motor-driven threaded spindle with a angle encoder.

In accordance with a further preferred embodiment, the insertion sliders 14, 16 can also be fastened, instead of on linear guides 42, 43, but instead with both ends on respective pivot alms, not represented, of the approximate length of the cylinder diameter, and which are seated fixed in place on a lateral frame and which can be actuated by means of work cylinders. A back-and-forth movement is also achieved by this. The movement takes place on a short section of a circular curved track of large diameter, i.e. approximately parallel to the plane 10 (A) stretched from the fastening slit 4, 6.

Figure 4:
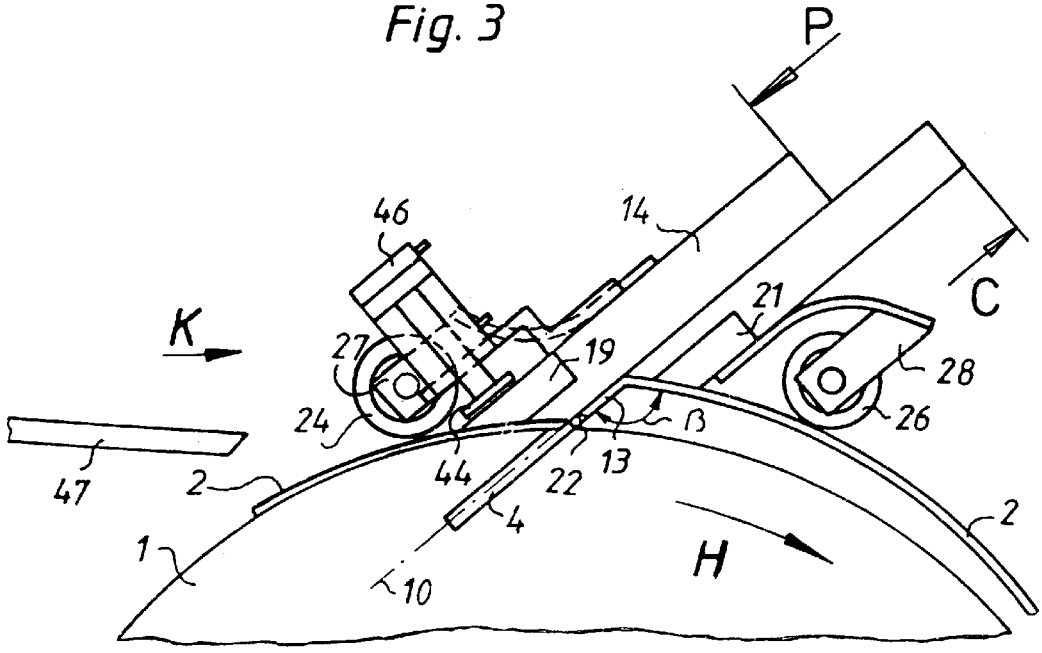

In accordance with another preferred embodiment, as seen in FIGS. 4 and 6, at least one plunger 44, which can be moved back and forth in the direction toward the rear insertion slider 16, is fastened on the front 29 of the front insertion slider 14. It is moved by means of a motor 46 for straight movements, for example a pneumatic work cylinder or an electric lift magnet. The plunger 44 is extended through a through-bore of the front insertion slider 14, and in the extended state it projects sufficiently far so that it can contact the trailing suspension leg 13 at some distance. It is also possible to use gear motors for rotating movements, for example a gear motor for driving a cam disk.

The insertion slider 14, 16 is usefully designed plate-shaped, as seen in FIG. 6, but can also be embodied to be railing-like.

Figure 2:
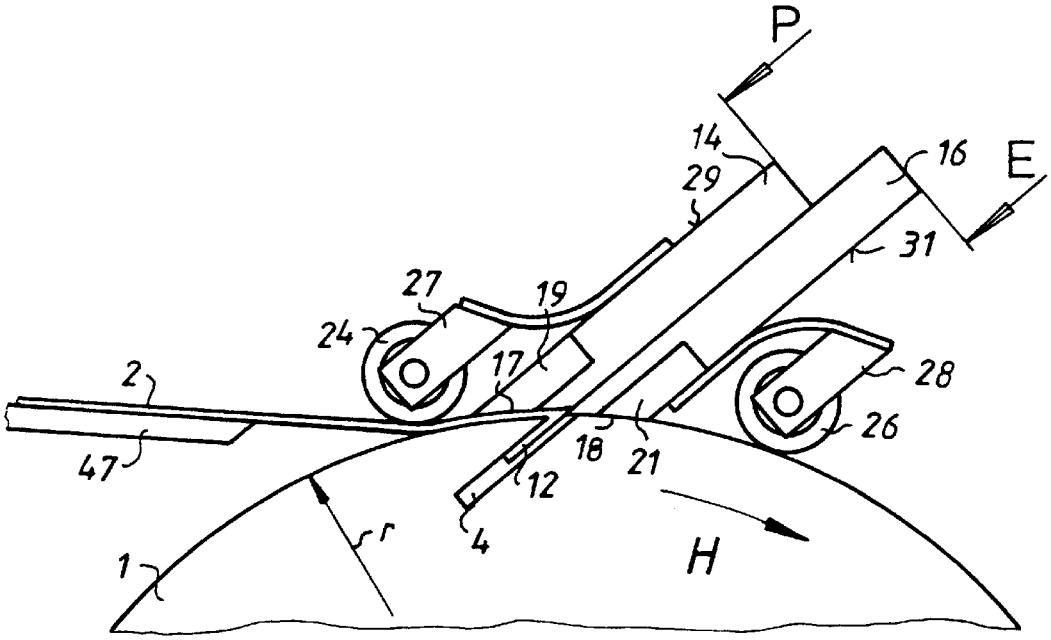
Figure 3:
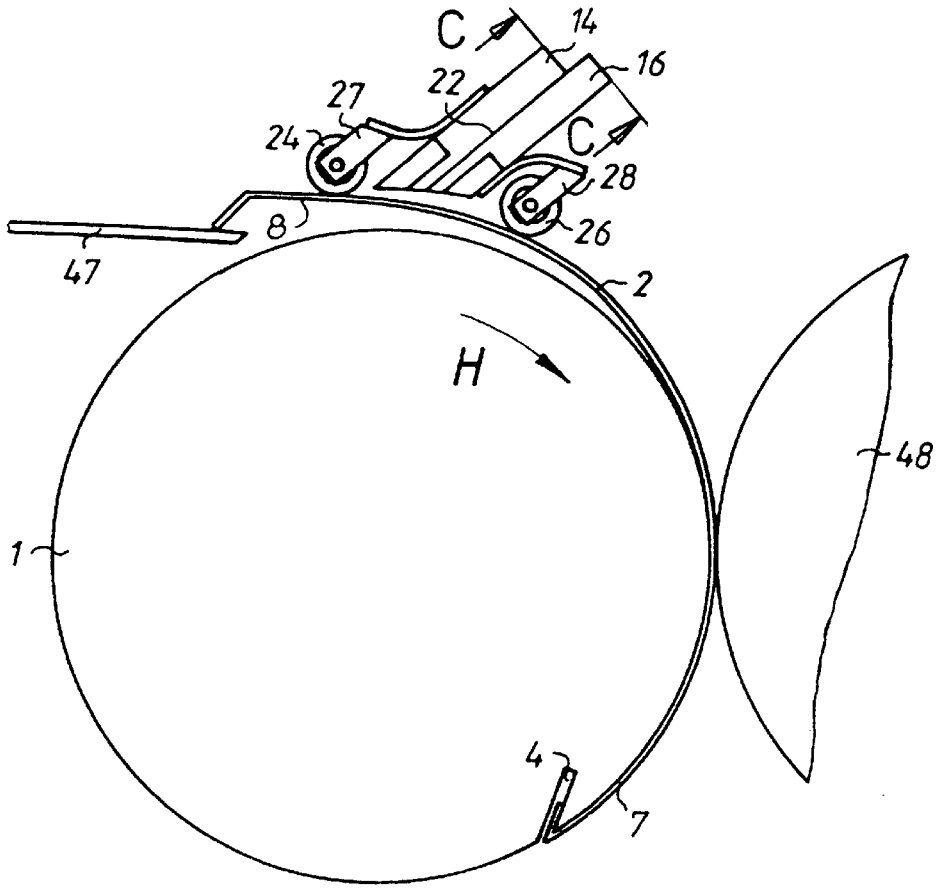

A method for mounting a flexible plate 2 in accordance with the present invention takes place as follows. The cylinder 1 is placed into a mounting position, i.e. the center line 10 of the fastening slit 4 is aligned with the guide surface 23 along the plane A of the rear insertion slider 16 as seen in FIG. 1. The front insertion slider 14 is brought into its topmost position C, the rear insertion slider 16 into its lowermost position E. An operator or a device pushes a plate 2 along a horizontal, height adjustable guide 47, for example, until the beveled leading end leg 12 rests against the guide surface 23 of the insertion slider 16. Thereafter, the front suspension leg 12 is pushed by the front insertion slider 14 by means of the underside 17 of the latter into the fastening slit 4. At the end of the insertion of the leading leg 12, the insertion sliders 14, 16 are in the respective positions P, E which is shown in FIG. 2. Thereafter, both insertion sliders 14, 16 are returned into their uppermost positions C, C as seen in FIG. 3.

Because the pressing rollers 24, 26 each synchronously follow the movement of the insertion slider 14, 16, at the end of the insertion of the beveled leading end leg 12 they rest resiliently on the plate 2.

Subsequently, the cylinder 1 rotates in the production direction H. In the process, the resiliently seated pressing rollers 24, 26 press the plate 2 against the surface 3 of the cylinder 1. An adjoining second cylinder 48, for example a lubber blanket cylinder, is placed against the cylinder 1. In the course of the rotation of the two cylinders, the plate 2 is rolled onto the cylinder 1, again as seen in FIG. 3. In place of the second cylinder 48, another pressing element, for example a roller which can be pivoted in, for example an ink application roller, can be used.

Figure 5:
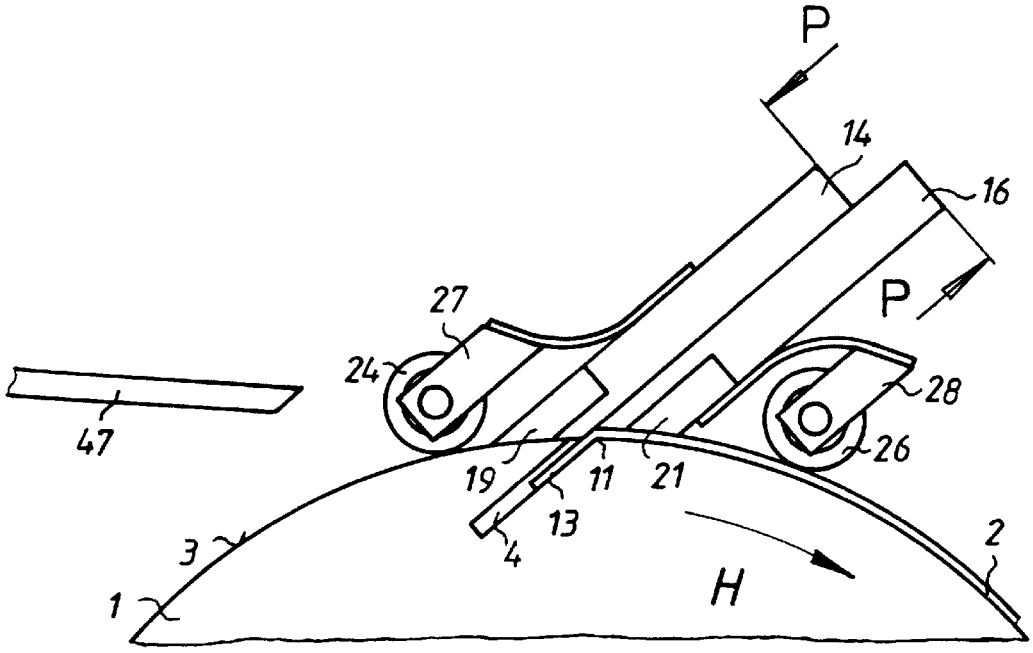

Because of the rotation of the cylinder 1, the trailing end 8 of the plate 2 comes into the vicinity of the insertion slider 14, 16, or respectively into the vicinity of the fastening slit 4. The trailing end suspension leg 13 projects away from the surface 3 of the cylinder 1. The cylinder 1 rotates until the centerline 10 of the fastening slit 4 is aligned with the guide surface 22 of the front insertion slider 14, i.e. lies on the plane A. In accordance with the first preferred embodiment, the plunger 44 is now activated, so that the plunger 44 pushes against the trailing suspension leg 13 in the direction toward the second insertion slider 16, which is in the position C. At the same time, the insertion slider 14 is moved into its lowermost position E. During this movement the plunger 44 is slowly retracted into its initial position which is shown in FIG. 4. In the meantime, the rear suspension leg 13 rests against the guide surface 22 of the front insertion slider 14 also as seen in FIG. 4. The rear insertion slider 16 is now moved from the position C into the position P, presses on the bevel of the leg 13 of the plate 2 and pushes it into the fastening slit 6 as shown in FIG. 5.

The removal of the plates takes place in the reverse sequence. The suction openings 19, 21 of the respective insertion slider 14, 16 are provided with suction air for pulling the legs 12, 13 of the plate 2 out.

For aiding the removal of the plate 2, it is also possible to arrange a respective device for releasing plates with beveled edges on the bottom of the fastening slit 4. Such a device is described in DE 195 09 562 C1 and has a leaf-shaped plate end lifter, which can be inserted into the fastening slit 4, 6 from the interior of the cylinder 1.

Figure 7:
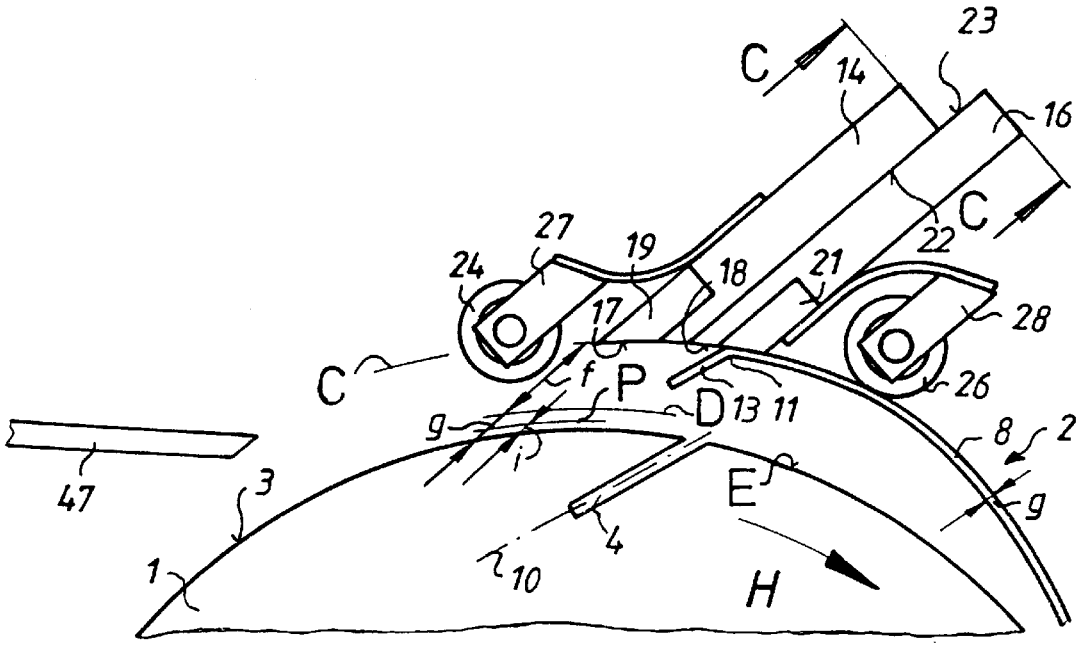

In accordance with a second preferred embodiment of the method, in the course of mounting the plate 2, the cylinder 1 is rotated in the production direction H until the end 8 of the plate 2 rests with its rear suspension bevel 11 against the underside 18 of the rear insertion slider 16. Then both insertion sliders 14, 16 are in the position C which is shown in FIG. 7.

Thereafter, the first insertion slider 14 is displaced in the direction toward the surface 3 into the position E, and then the cylinder 1 is turned back counter to its production direction until the center line 10 of the fastening slit 6 is aligned with the guide surface 22. Finally, the rear suspension leg 13 is pushed along the guide surface 22 of the first insertion slider 16 into the fastening slit 6 in a manner analogously with the representation in FIG. 5.

While preferred embodiments of a method and a device for assembling flexible plates, such as printing plates in accordance with the present invention have been set forth fully and completely hereinabove, it will be apparent to one of skill in the art that a number of changes in, for example, the specific type of flexible plate, the drive for the cylinder and the like could be made without departing from the true spirit and scope of the present invention which is accordingly to be limited only by the following claims.

What is claimed is:

1. A device for mounting a flexible printing plate, having a leading printing plate suspension leg beveled at a first angle, and a trailing printing plate suspension leg beveled at a second angle, on a cylinder having a leg receiving fastening slit placed obliquely on a surface of said cylinder with respect to a diameter of said cylinder and extending in a direction into said cylinder, said device including a trailing printing plate suspension leg insertion slider supported for movement in said direction of said leg receiving fastening slit, means for displacing said trailing printing plate suspension leg insertion slider in said direction of said fastening slit, a leading printing plate suspension leg insertion slider supported for movement in said direction of said leg receiving fastening slit, and means for displacing said leading printing plate suspension leg insertion slider in said direction of said fastening slit.

2. The device in accordance with claim 1 wherein both said trailing suspension leg insertion slider and said leading suspension leg insertion slider can be stopped in more than two positions.

3. The device of claim 1 wherein each said insertion slider has a linear drive.

4. The device of claim 1 further wherein each said insertion slider carries a plurality of resilient rollers.

5. The device of claim 1 further including a plunger carried by said leading suspension leg insertion slider and engageable with said trailing suspension leg insertion slider.

6. The device of claim 1 wherein said insertion sliders are plate-shaped.

7. The device of claim 1 wherein each of said insertion sliders has an underside facing said cylinder and further including suction openings on each said underside, said suction openings drawing a plate end to each said underside by suction.

8. The device of claim 1 wherein each said insertion slider has an underside facing said cylinder, said underside of each said insertion slider being concave and matched to a curvature of said cylinder.

9. The device of claim 1 further including a back surface for each said insertion slider, said back surfaces contacting each other and forming a guide surface and a sliding surface for each other.

10. The device of claim 1 wherein said insertion sliders are parallel to each other and extend along a width of a flexible plate to be mounted on said cylinder.

11. The device of claim 1 further including insertion slider pivot arms, said pivot arms being seated in radial curved tracks on a frame, said insertion sliders being supported in said pivot arms.

12. A method for mounting a flexible plate on a cylinder including:

providing a plate leading suspension leg beveled at a first angle;

providing a plate trailing suspension leg beveled at a second angle;

providing at least one plate end insertion slit on said cylinder;

providing a plate end insertion device having a rear insertion slider with a rear guide surface and a front insertion slider with a front guide surface;

moving said plate leading suspension leg against said rear guide surface;

moving said front insertion slider toward said cylinder and inserting said plate leading suspension leg into said plate end insertion slit;

rotating said cylinder in a production direction and bringing said plate trailing suspension leg adjacent said plate end insertion slit;

retracting said rear insertion slider away from said cylinder at a distance greater that a length of said plate trailing suspension leg;

rotating said cylinder further in said production direction and positioning said plate trailing suspension leg under said rear insertion slider;

moving said front insertion slider into contact with said cylinder;

rotating said cylinder opposite to said production direction;

bringing said plate trailing suspension leg into engagement with said front guide surface; and moving said rear insertion slider toward said cylinder and inserting said plate trailing suspension leg into said plate end insertion slit.

* * * * *